US005328075A

United States Patent [19]

Marks

[11] Patent Number: 5,328,075

[45] Date of Patent: * Jul. 12, 1994

[54] MANUAL STAPLE GUN

[75] Inventor: Joel S. Marks, Los Angeles, Calif.

[73] Assignee: Worktools, Inc., Chatsworth, Calif.

[ * ] Notice: The portion of the term of this patent subsequent to Nov. 24, 2009 has been disclaimed.

[21] Appl. No.: 957,213

[22] Filed: Oct. 5, 1992

Related U.S. Application Data

[63] Continuation of Ser. No. 772,536, Oct. 7, 1991, Pat. No. 5,165,587.

[51] Int. Cl.[5] ..... B25C 5/11

[52] U.S. Cl. ..... 227/132; 227/146

[58] Field of Search ..... 227/132, 146

[56] References Cited

U.S. PATENT DOCUMENTS

| | | | |
|---|---|---|---|
| 2,326,540 | 8/1943 | Krautz | 227/132 X |
| 2,668,290 | 2/1954 | Heller . | |
| 2,671,215 | 3/1954 | Abrams | 227/132 |
| 2,746,043 | 5/1956 | Heller . | |
| 2,769,174 | 11/1956 | Libert | 227/132 |
| 3,610,505 | 5/1969 | Males | 227/132 X |
| 4,126,260 | 11/1978 | Mickelsson . | |
| 4,184,620 | 1/1980 | Ewig . | |
| 4,204,622 | 5/1980 | Smith et al. | 227/7 |
| 4,452,388 | 6/1984 | Fealey . | |
| 4,629,108 | 12/1986 | Judge | 227/132 |
| 4,640,451 | 2/1987 | Steiner et al. | 227/120 X |

FOREIGN PATENT DOCUMENTS

| | | | |
|---|---|---|---|
| 807937 | 1/1959 | United Kingdom | 227/132 |
| 2229129 | 9/1990 | United Kingdom | 227/146 |

*Primary Examiner*—Rinaldi I. Rada

*Attorney, Agent, or Firm*—Poms, Smith, Lande & Rose

[57] ABSTRACT

A manually powered fastening tool which stores and instantly releases the energy of a spring such that it may force a staple type fastener into an object by an impact blow. In the present invention the squeeze handle is hinged near the end of the tool body opposite the end from which the staples exit. The user grips the tool near the staple exit end and pushes the squeeze handle toward the intended staple impact point. This novel arrangement causes the user to force the staple into the receiving object with the same hand that pushes the squeeze handle toward the tool body, while the prior art typically requires use of a second hand to hold the tool firmly upon the staple impact point. Improving from the prior art, the present design ensures that the staple exit end of the tool body will not lift away from the receiving object. The energy storage spring and handle engagement linkage are located remotely from the plunger in the present design. This allows the user to fully grip the tool near the staple exit end of the tool body. The motion of installing a staple with this novel staple gun is therefore similar to the intuitive motion used with a common desk top stapler.

8 Claims, 2 Drawing Sheets

BACK
FRONT
THUMB SIDE
12
22
52
41
34
15
23
42
26
51
14
20
32
24
30
10
25
83
21
61
36

MANUAL STAPLE GUN

This is a continuation application of Ser. No. 07/772,536, filed Oct. 7, 1991 now U.S. Pat. No. 5,165,587. Applicant has also filed co-pending application Ser. No. 07/899,748 on Jun. 17, 1992; and co-pending application Ser. No. 08/016,800, on Feb. 11, 1993.

BACKGROUND

1. Field of Invention

This invention relates to manually powered impact stapling and tacking machines.

2. Description of Prior Art

Manually powered impact type stapling and tacking machines are well known. Such devices generally comprise a body, an energy storage spring, a fastener feeding system, a movable operating handle to deflect the energy storage spring, a mechanism to rapidly disengage the handle from the deflected spring, and a sliding plunger linked to the spring to impact the fastener.

The prior art demonstrates numerous means to link the operating handle to the mechanism of the machine. Typically the handle is hinged near the front of the body, front being the end from which the staple exits. To move the handle, the user presses downward and rearward with the palm of the hand. A second configuration has the handle and gripping portion of the tool body reversed so that the handle is pulled upward with the fingers while the palm of the hand presses downward upon the body. Either configuration is limited in utility because of the manner in which the forces must be applied by the operating hand.

By the first arrangement the operating hand must press toward the rear of the tool since leverage is available on the handle only behind the frontwardly mounted handle pivot. Therefore, to effectively install a fastener with this arrangement, a second hand is often required to push on the front of the tool to press the fastener into the installation point. The second hand also serves to prevent the staple exit end of the tool body from jumping away from the ejecting staple. Efficient one handed operation of such prior art staple guns is not possible. To press down upon the front end, the single operating hand must move closer to the handle pivot point. However, such a position reduces the leverage available to deflect the energizing spring.

Abrams U.S. Pat. No. 2,617,215 attempts to address this issue by placing the handle pivot further toward the front of the body and adding various linkages to enable such a handle to lift the plunger. The extreme forward pivot placement allows for leverage on the handle at a more forward position on the tool body. However, Abrams' design only marginally improves upon the prior art to allow efficient one hand operation.

In this configuration, a single hand may both pull the operating handle and push forward on the tool body. But since the operating handle must be pulled by just the finger, the power of the user's arm is not available to compress the energy storage spring in the tool.

Libert U.S. Pat. No. 2,769,174 and Krantz U.S. Pat. No. 2,326,540 approach a solution to the force application issue by placing the operating handle pivot at the rear of the tool body. However, these versions retain the typical front mounted energy storage spring and linkages. The hand grip of the tool must therefore be set back from the front to allow space to accommodate the spring and related linkages. These versions therefore only partially address the issue of efficient force application. The designs of Libert and Krantz do not allow the user's hand to push the handle from a position directly over the exiting staple. Hence they do not fully realize benefits from a rearwardly hinged handle design.

Prior innovations comprise use of plastic, or stamped metal combined with plastic, to form the body of a staple gun. The goal of the prior efforts was to take advantage of the formability and low cost of plastic. Plastic has been added to mostly stamped metal housings to provide a more comfortable hand grip.

Fealey, U.S. Pat. No. 4,452,388 claims a staple gun which is constructed of a "molded plastic body . . . between sheet metal sides." Fealey cites several prior art uses of molded plastic and notes that molded plastic "simplifies assembly" but that too much plastic causes "clearly some sacrifice in the reliability and durability of the device."

Ewig, U.S. Pat. No. 4,184,620, shows a stapler where the housing frame is formed of plastic to "provide the major support and guide elements." Such a tool will be low cost and may readily provide compound curves in the grip opening region. However, such a tool feels light weight and flimsy, provides poor shock damping, wears poorly and generally feels low quality. Such all plastic tools will not be considered "professional" and in fact are presently sold only as "economy" products.

Judge, U.S. Pat. No. 4,629,108, shows a housing of stamped metal enveloped by plastic covers. The outside shape can thereby be aesthetically pleasing and comfortable. The metal frame provides the structural function while the plastic provides the form.

Michkelsson, U.S. Pat. No. 4,126,260, shows a plastic insert added to a stamped housing to provide a contoured hand grip. This feature is presently common in other stapled gun products.

Prior workers have clearly recognized the advantage and disadvantage of molded plastic in staple guns. However, the prior art does not realize the solution to this dilemma, a die cast metal staple gun housing.

Steiner et. al. U.S. Pat. No. 4,640,451, described a desk top stapler and hole punch which may be die cast. Similarly U.S. Pat. No. 3,630,428 discloses a desk top stapler with a die cast base. A die cast main body and base are further disclosed in U.S. Pat. No. 2,136,374 for a heavy duty desk top stapler.

Smith et. al., U.S. Pat. No. 4,204,622, shows a power tool with a die cast housing. Such a housing is common among power tools.

SUMMARY OF THE INVENTION

In the present invention, the hand grip extends to the front end of the tool body. This improvement is possible because of a novel arrangement which locates the spring and related linkages remotely from the plunger. The operating handle can extend the full length of the body and the body can now be effectively gripped up to the extreme front end of the handle. Unlike the prior art, the present design fully exploits the advantage of the rearwardly hinged handle since the user can essentially push out the staple in a motion similar to operation of a common desk top stapler.

In manual staple guns, the energy available to drive a staple is directly proportional to the linear travel of the gripping hand and the force applied to the operating handle. The present design allows placing the hand grip further from the hinge, serving to optimize the motion of the operating handle. This allows the angular change of the handle to be reduced so that the hand remains more nearly parallel to the tool body. A more comfortable hand motion results. This is a further advantage over the prior art.

Because hand force is applied more efficiently in the present invention, a lighter energy storage spring may be used to provide deeper fastener penetration than is achieved by one hand gripping the tools of the prior art.

Staple guns of the prior art have utilized housings of stamped steel or injection molded plastic. To improve the shock damping characteristics of stapling machines one embodiment of the present invention uses a die cast zinc housing. Die cast zinc contains the further benefit of long lasting integral guiding and bearing surfaces.

Several objects and advantages of the present invention are:

- to improve the hand motion required to operate a stapling machine such that less apparent effort will produce an equal or greater stapling effect compared to the prior art.
- to provide a design in which a force upon the operating handle of a stapling machine will maximally bias the tool body toward the object to be fastened.
- to provide a stapling machine which is optimized for one handed operation.
- to provide an impact type stapling machine wherein the operating motion is most similar to that of a common desk top stapler.
- to provide for gripping of a stapling machine at the extreme end of the tool from which the staple exits.
- to provide for an operating motion of a stapling machine that is more comfortable than with prior art.
- to provide for a stapling machine that operates with minimal shock upon staple ejection.

DETAILED DESCRIPTION OF THE ILLUSTRATED EMBODIMENT

Figure 2:
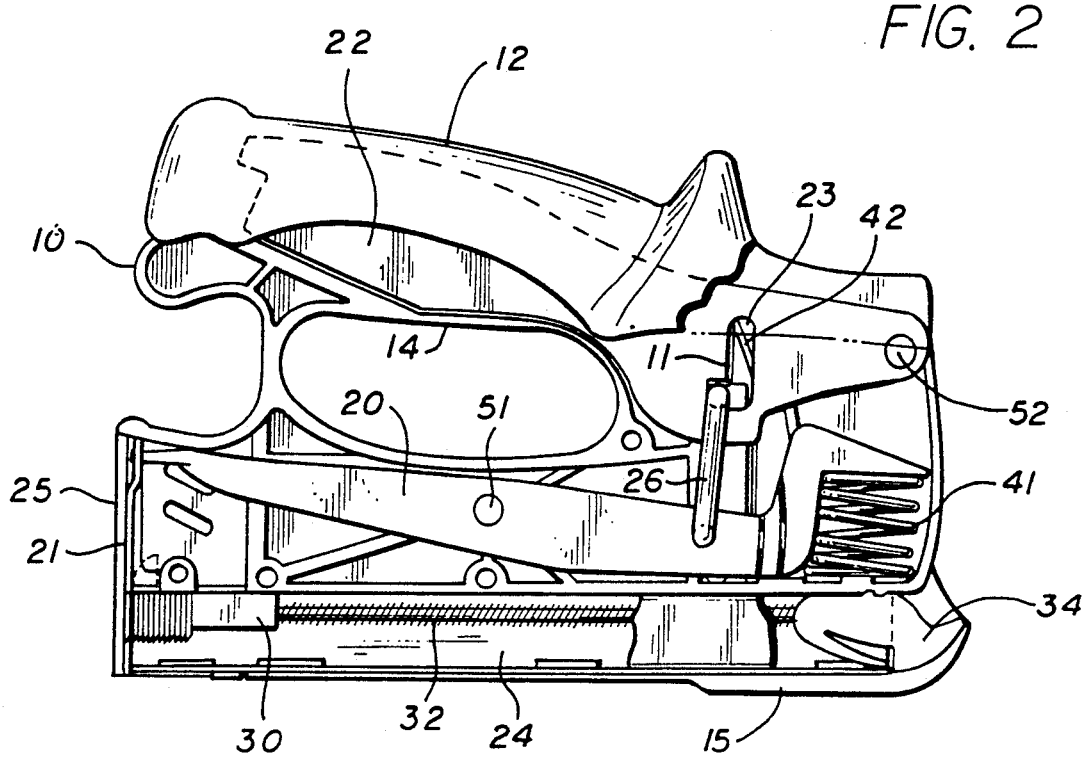
FIG. 2 is a side elevation of the staple gun of FIG. 1, with the grip handle fully drawn toward the tool body and spring energized as the tool would appear just prior to ejection of a staple.

A die-cast metal housing 10 consists of two opposing halves joined together to contain, guide and hold in position the functional components of the tool. Opening 14 is provided to receive the fingers of a gripping hand. The hand rests upon molded handle cover 12 such that the thumb faces away from pivot 52. Handle cover 12 fits over squeeze lever 22. A force transmitting lever 20 pivots about pin 51 to transfer the force generated by spring 41 to staple ejection plunger 21. As squeeze lever 22 is drawn toward housing 10 by pressing downward on the portion of squeeze lever 22 above staple ejection plunger 21, Engagement linkage 26 transfers the squeeze lever motion to the transmitting lever 20 because of the position of linkage 26 in slot 23 of the squeeze lever. As squeeze lever 22 approaches the end of its inward or downward stroke and the thumb side of squeeze lever 22 approaches staple ejection plunger 21, linkage 26 becomes unstable within its position in the short leg of slot 23 because of the geometry of slot 23. Linkage 26 is prevented from sliding within slot 23 toward lever pivot 52 by steel guide 11, which protrudes from the inside of zinc housing 10 and slidably contacts the end of linkage 26 within slot 23. Guide 11 is visible in FIG. 2. At the extreme end of the stroke of the squeeze lever, unstable linkage 26 slides down past guide 11 and passes to the other side (the right hand side as seen in FIG. 2) of the guide 11 and into the long leg of slot 23. The end of linkage 26 within slot 23 is then free to travel within the long leg of slot 23 until it is near the end of slot 23 opposite the initial position of the linkage 26. Spring 41 which has been compressed by the motion of force transmitting lever 20 is free to expand, driving linkage 26 upwards within slot 23, and simultaneously driving plunger 21 downwards by pivoting force transmitting lever 20 about pivot 51. At this point the components are in the configuration shown in FIG. 3.

Figure 1:
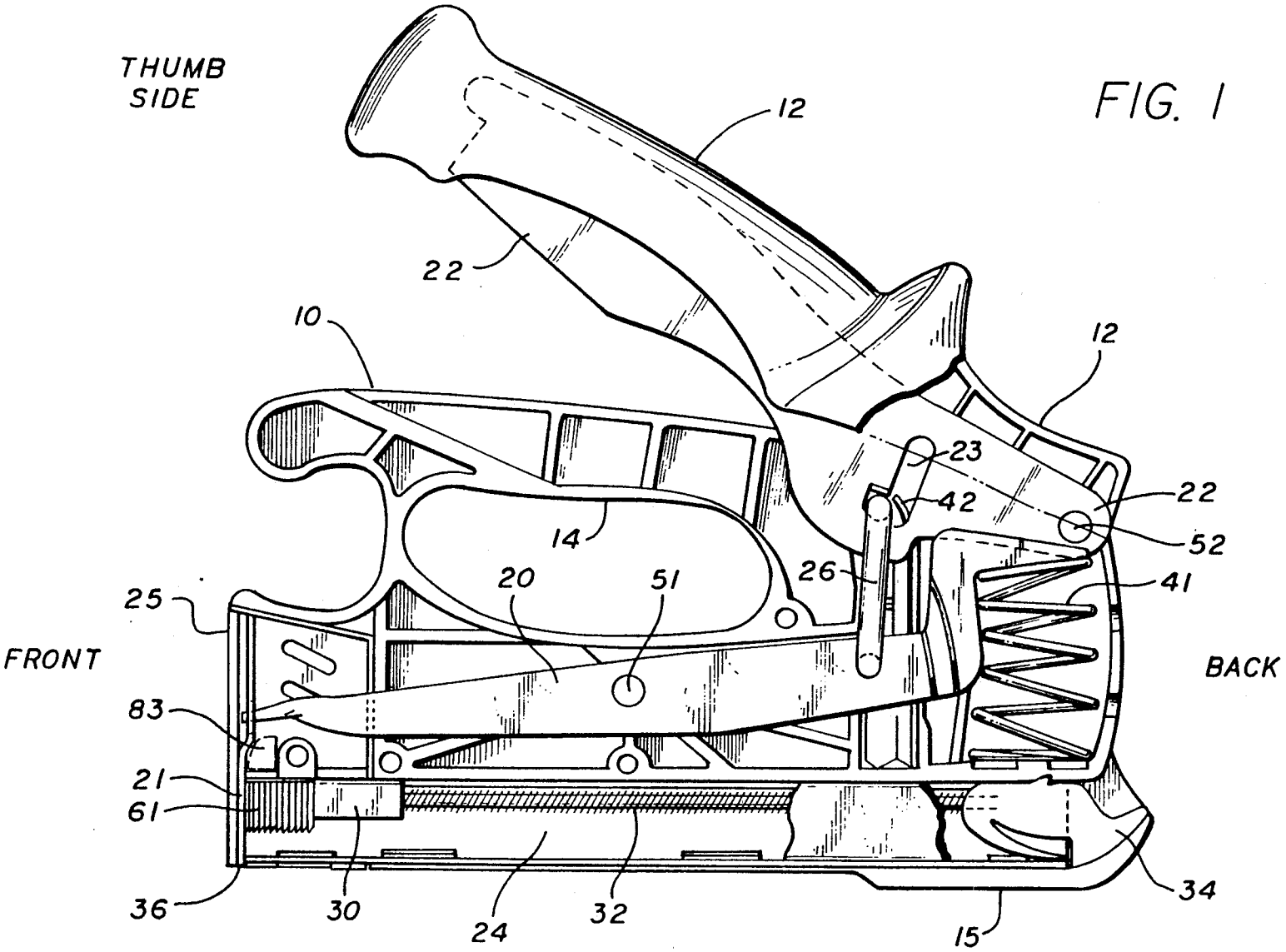
FIG. 1 is a side elevation, partly in section, of a staple gun constructed according to one embodiment of the invention, with its grip handle in an extended position and energizing spring in its rest state, as the tool would appear before commencing an operating sequence.

As spring 41 is compressed, the end of force transmitting lever 20 opposite spring 41 raises staple ejection plunger 21 to admit a staple 61 into ejection chamber 36. The nose piece 25 of the housing 10 includes guide means, that is, the channels leading up to the area into which the staple ejection plunger 21 retracts when it is raised by lever 20, as shown in FIG. 2. Staples 61 are biased toward the plunger by spring loaded assembly 30 and 32. Plunger 21 is configured with an offset such that the section where plunger 21 and force transmitting lever 20 engage each other is in a plane substantially parallel to the plane occupied by the portion of plunger 21 within ejection chamber 36 when the staple gun is not in use, as shown in FIG. 1. With this design, a protruding portion of nose piece 25 to accommodate a connection of lever 20 to plunger 21 is unneeded.

Molded end piece 34 holds spring loaded assembly 30 and 32 inside one piece staple feeding channel 24. End piece 34 is a one piece component. It is protected at the end opposite spring loaded assembly 30 and 32 by protrusion 15.

Figure 3:
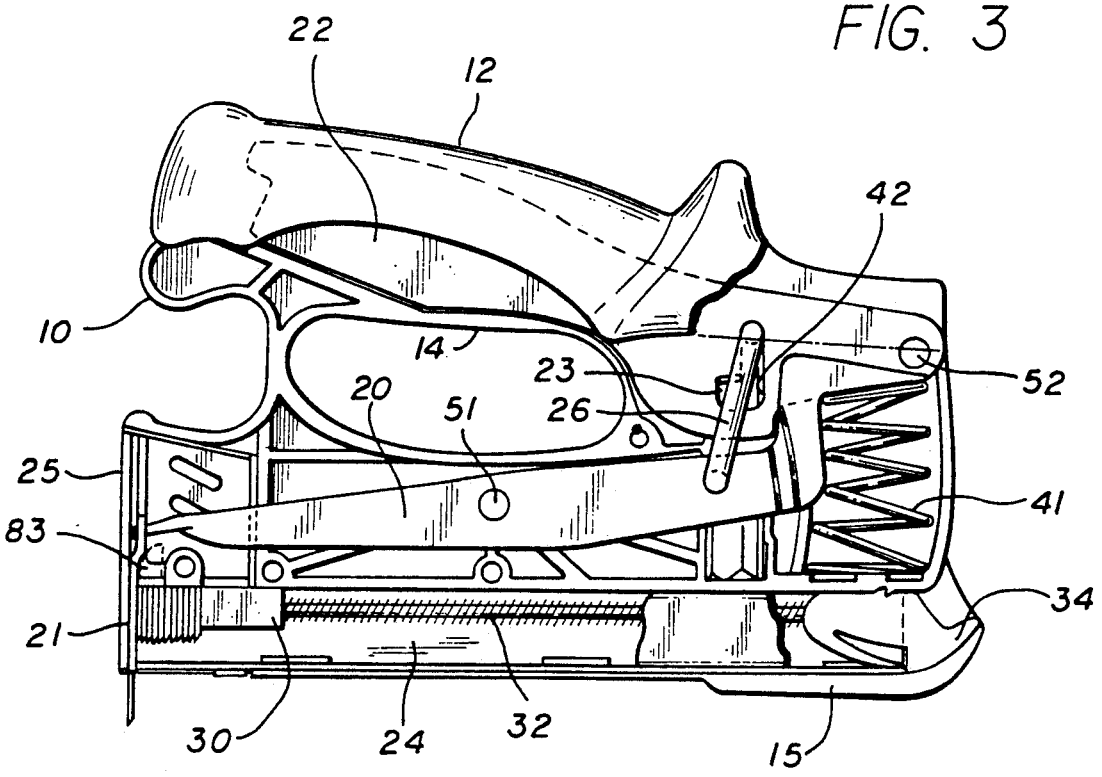
FIG. 3 is a side elevation of the staple gun of FIG. 1, with the spring in its rest state and the handle fully drawn toward the tool body, as the tool would appear just after ejection of a staple.

A shock absorbing member 83 is provided in a preferred embodiment to arrest or dampen the motion of lever 20 as it drives a staple through ejection chamber 36, as shown in FIG. 3.

As squeeze lever 22 is released to its extended position, linkage 26 is biased away from pivot 52 by spring 42 so that linkage 26 returns to its rest position within the short leg of slot 23.

Suitable fasteners, not shown, are provided to secure housing halves 10 together (one half is not shown). Housing protrusion 15 contacts the plane of the surface into which the staple is inserted. By this arrangement the tool of the present invention contacts the surface being fastened only at the staple insertion point and at protrusion 15. Therefore the staple insertion point will not be held off the fastening surface by small irregularities in the surface.

There has been described hereinabove a novel staple gun. Those practiced in the art may make variations of the above invention without departing from the inventive scope which is determined solely by the following claims.

What is claimed is:

1. A fastening tool comprising:

a housing;

a first lever pivoted within and essentially along the length of said housing, and having first and second ends;

a plunger oriented to engage fasteners in order to expel them from said housing, said plunger pivotally connected to said first lever near the first end thereof;

a second lever pivoted with respect to said housing at a first end;

linking means releasably connecting said first lever to said second lever, said linking means having a first position such that movement of said second lever towards said housing is transferred to said first lever near the second end thereof, and a second position such that said first lever and said second lever are free to move independently of each other;

said linking means further comprising an L shaped slot in said second lever having short and long legs, said slot slidably receiving a linking member connecting motion of said second lever to said first lever, said first position of a linkage means being when said linking member occupies the short leg of said L shaped slot, said second position being when said linking member occupies the long leg of said L shaped slot, said slot enabling rapid de-linkage of the first lever from the second lever near a particular angular position of the second lever relative to said housing, a first spring located adjacent to said first lever such that said first spring is deflected from its rest state as said second lever is moved towards said housing;

a release point of said linking means which causes said linking means to move from said first position to said second position, said release point located at a point such that said second end of said second lever is substantially adjacent to said housing, release of said linking means allowing said first spring to return to its rest state;

a channel through which fasteners are fed, said plunger raised above said channel sufficiently to permit a fastener to move beneath said plunger when said second end of said second lever is nearly substantially adjacent to said housing while said linking means is in said first position, said plunger forced through said channel by said first lever and said first spring once said linking means moved from said first position to said second position;

said plunger defining a plane of motion of said plunger as said plunger is alternately raised and lowered;

a hand grip opening comprising a region substantially immediately above said plunger.

2. The tool of claim 1, in which said hand grip opening comprises a region passing through the plane of motion of said plunger as said plunger is alternately raised and lowered, said hand grip opening located immediately above said plunger.

3. The tool of claim 1, in which said first spring is located towards the second end of said first lever and said plunger is located towards the first end of first lever;

said first lever pivoting about a point of said first lever.

4. The tool of claim 1, in which said second lever rotates about a pivot which is located at one end of the length of said housing, such end being at the opposite end from said plunger.

5. The tool of claim 1, in which said second lever contains an L shaped slot through its thinnest dimension, wherein the slot slidably receives a linking member to link motion of the second lever to said first lever, such slot further enabling rapid delinkage of the first lever from the second lever at a specific angular position of the second lever relative to said housing.

6. A fastening tool comprising:

a housing having a front, back, top, bottom, first and second sides;

a fastener guide track near the bottom of said housing to guide fasteners towards the front of said housing;

an opening in said fastener guide track located in the bottom of said fastener guide track, at said front of said housing;

a plunger located at said front of said housing, said plunger having a top and bottom portion and raised and lowered

7. The tool of claim 6, in which said spring is preloaded when in an initial position, and in which movement of said plunger comprises movement of minimal reciprocating mass relative to the total weight of the tool. positions, said bottom portion of said plunger selectively passing into said opening in said guide track in said lowered position, and oriented to expel objects located upon said fastener guide track out of said opening in said guide track when said plunger is alternately raised above said guide track in said raised position and lowered towards said lowered position;

guide means within said housing located above said opening in said guide track for guiding said plunger as said plunger is alternately raised and lowered;

a spring member oriented to apply force tending to force said plunger towards said opening in said guide track onto said lowered position;

a first lever mechanically linking said plunger and a second lever;

said second lever having first and second ends, said first end located substantially immediately above the front of said housing, said second end pivotally connected to said housing near the back of said housing;

at least one hand grip opening through said first and second sides of said housing, said hand grip opening elongated from front to back;

said second lever having a first position wherein the first end is pivoted away from said housing and a second position wherein the first end is pivoted towards said housing, and wherein the second lever defines an arc when moving between the first and second positions, and said plunger is located at a tangent of the arc; and wherein said first end of said second lever is disposed in an overlying position above the front of at least one of the hand grip openings.

8. The fastening tool of claim 6, in which said first lever is pivotally attached to the housing under said hand grip opening.

* * * * *

UNITED STATES PATENT AND TRADEMARK OFFICE

CERTIFICATE OF CORRECTION

PATENT NO. : 5,328,075

DATED : July 12, 1994

INVENTOR(S) : Joel S. Marks

It is certified that error appears in the above-identified patent and that said Letters Patent is hereby corrected as shown below:

The text of claim 7, at column 6, lines 24-28 ending with the word "tool." should be moved to and inserted as a new paragraph after the word "openings." at column 6, line 60.

In column 6, line 40, in claim 6, the word "onto" should be replaced with --into--.

In column 6, line 54, in claim 6, the word "towards" should be replaced with --toward--.

Signed and Sealed this

Eleventh Day of October, 1994

*Attest:*

Bruce Lehman

BRUCE LEHMAN

*Attesting Officer*

*Commissioner of Patents and Trademarks*